United States Patent [19]

Sieg

[11] Patent Number: 4,580,365

[45] Date of Patent: Apr. 8, 1986

[54] AUTOMATIC DOOR LOCK

[75] Inventor: Giselher Sieg, Ratingen, Fed. Rep. of Germany

[73] Assignee: Dorma-Baubeschlag GmbH & Co. KG, Ennepetal, Fed. Rep. of Germany

[21] Appl. No.: 555,693

[22] Filed: Nov. 28, 1983

[51] Int. Cl.[4] ..... E05F 11/00

[52] U.S. Cl. ..... 49/336; 49/137; 16/49; 16/58

[58] Field of Search ..... 49/333, 334, 335, 336, 49/137; 16/49, 66, 58, 62, 69, 64

[56] References Cited

U.S. PATENT DOCUMENTS

| | | | |
|---|---|---|---|
| 4,010,572 | 3/1977 | Peterson | 16/62 Y |
| 4,040,144 | 8/1977 | Lasier et al. | 49/137 X |
| 4,115,897 | 9/1978 | Zunkel | 16/49 |
| 4,220,051 | 9/1980 | Catlett | 49/336 X |
| 4,339,843 | 7/1982 | Burnett, Sr. | 16/62 |
| 4,483,043 | 11/1984 | Tillmann | 16/58 |

*Primary Examiner*—Kenneth Downey
*Attorney, Agent, or Firm*—Michael J. Striker

[57] ABSTRACT

In a door lock comprised of an elongated housing in which a piston loaded with a spring is displaceable in two opposite axial directions, a rotatable locking shaft connected to the door wing and provided with a pinion engaged with a rack formed on that piston, the spring is prestressed in the direction of the closing of the door. The spring acts on a displaceable supporting member which displaces the piston in the housing of the lock. An electromotor actuated by a control unit is operated to displace the supporting member.

13 Claims, 2 Drawing Figures

AUTOMATIC DOOR LOCK

BACKGROUND OF THE INVENTION

The present invention relates to an automatic door lock in general. More particularly, this invention pertains to an automatic door lock provided with a locking shaft which is loaded in the direction of closing the door wing with a spring arrangement, and having a hydraulic piston-cylinder unit with a displacable piston, which effects the rotation of the locking shaft and serves the purpose of dampening the piston's movement.

Door locks of the type under discussion have been designed to hold the door wing normally in the closed position, to enable the closed door to perform such protective functions as protection against fire, sun rays, noise, burglary and maintaining privacy behind the closed door. Such doors are usually provided with a door lock having a hydraulic damping means which has a spring arrangement with the aid of which an energy required for automatic closing of the door is stored during opening of the door by hand and then used, after the door has been completely opened, for closing of the door wing. The automatic movement of the door in the closing direction is damped by means of a hydraulic throttle system and therefore such doors provide for a great comfort, reliability and safety in use.

Available door locks, although they correspond to the present standards should nevertheless provide for a reliable and safe closing of the door wing and also should ensure the safety and quietness by the above noted hydraulic damping system. The door locks with hydraulic damping are standardized; however the quality requirements and the control lines of these locks have been constantly improved.

Although conventional door locks correspond to high technical standards one of the disadvantages of known door locks resides in that an energy required for the closing movement of the door wing must be first applied by a person during the opening movement of the door. This disadvantage makes it particularly difficult or even impossible to handle large and heavy doors, particularly to children or older weak persons. Very often it is impossible to close or open such a door to without help by another person.

To avoid some problems in conventional door locks a door lock has been suggested, provided with a special locking arrangement which has been disclosed, for example in German patent publication DE-OS 25 41 790. In the reference door lock arrangement, the door wing is adjusted to a predetermined opening angle. The return flow opening formed in the piston of the reference arrangement is closed by a needle insertable into that opening. Furthermore, this return flow opening in the piston, closeable by the needle has a return flow passage provided with a throttle arrangement. This return flow passage can be opened or closed through an electromagnetic holding valve. When this return flow passage is closed by the electromagnetic holding valve the door wing remains in the open position only when the return flow conduit located in the piston of the door lock is closed by the needle. First, when the electromagnetic holding valve is opened in the case of danger, the lock spring is in the position in which the piston and the door wing therewith are moved to the closed position. Such doors should be constantly watched because in the case of certain emergencies, such as fire, the special locking arrangement of the door must be released to give to the door wing the necessary property of self closing.

In the other door locks, one of which is for example disclosed in German patent publication DE-OS 2751859, the disadvantage of an uneasy opening of the door wing is overcome in that the energy for the opening process is stored during the closing of the door. In the reference device a so-called free-running door lock is employed, in which the lock spring is blocked in its prestressed position and in which a second piston is interconnected between the first piston, arranged in engagement with the locking shaft, and the lock spring. The return flow conduit extended through the second piston is eventually closed or opened in the case of danger, by means of an electromagnetic control valve. Under normal conditions the pressure medium does not flow out from the pressure space of the first piston arranged in engagement with the locking shaft because the return flow conduit is closed, so that the pistion connected to the locking shaft can be displaced without any resistance in two opposite directions within the pressure space of the cylinder whereby the door wing coupled to the locking shaft can be easily opened or closed by hand. It is obvious that the door remains in its open position if a person does not close it by hand, and therefore the door lock of such a door wing must be always coupled with special control devices, such as smoke alarm systems or fire detecting devices, which, in the case of danger, would close the door wing automatically.

A further disadvantage of conventional door locks is that the door wing should be allowed to remain open of closed for safety purposes although modern people certainly prefer to have automatically closing doors everywhere.

So-called door automates have been suggested, through which the door wing can be automatically opened before a person entering the building or closed behind the person leaving the building. These devices are, however, very costly and are of the same type as those described herein above.

SUMMARY OF THE INVENTION

It is an object of the present invention to provide an improved door lock.

It is another object of this invention to provide a door lock in which a self closing of the door wing is effected each time after each opening of the door wing and which lock enables a troubleless opening of the door without a substantial energy consumption.

These and other objects of the invention are attained by an automatic door lock for automatically opening and closing a door wing, comprising a housing having an elongated cylindrical portion formed with a cylindrical bore, a hydraulic piston-cylinder unit including a piston displaceable in said bore, a rotatable locking shaft connected to the door wing and cooperating with said piston and rotatable upon displacing of said piston in said bore to effect a movement of the door wing to a closed position and to an opened position; spring means disposed in said bore and operative for loading said piston and said locking shaft in the direction of closing the door wing, said piston-cylinder unit having a pressure chamber having a pressureless space, said housing being formed with a pressure medium return passage; throttle means in said return passage; a check valve opening into said pressure chamber, said pressure chamber of the piston-cylinder unit being at one side thereof connected with said return passage via said throttle means and at another side thereof with said check valve, and a movable supporting member interconnected between said piston and said spring means, said supporting member being controllably driven by an external energy in the direction of prestressing of said spring means in dependence upon operation of the door wing.

Due to the specific structure of the door lock according to the invention, a user does not apply any force for prestressing of the spring means so that the entire process of opening the door is significantly facilitated. The energy required during the movement of the doore to the open position, for stressing the locking spring is applied by an external energy source, whereby the spring means is automatically prestressed. After the movement of the door wing to the open position has been completed the force or energy stored by the spring can be used for automatic closing of the door.

According to a further concept of the invention, the door lock may further include an electronic control unit and an electromotor electrically connected to said unit and operative for driving said supporting member, the movement of said supporting member being controlled by said control unit upon the operation of the door wing.

For maintaining a quick movement of the piston and for transmitting signals corresponding to that movement to the control unit the door lock may further include a signal coil system electrically connected to said control unit for generating control signals transmitted to said control unit, said signal coil control system being operatively connected to a pressure space located in said housing before said piston and being operative under underpressure.

The supporting member may be formed as a threaded nut loaded by said spring means to displace said piston. The lock may further comprise an elongated spindle having a thread thereon and mounted in said bore of said housing portion, said threaded nut surrounding said spindle and being guided in said bore unrotationally, said spindle extending through said spring means and being rotatably but axially stationarily supported in said housing portion within said bore. The housing portion may be formed with an elongated guide groove in the region of said bore for guiding said threaded nut in the movement thereof in said bore. A transmission unit, having a brake, may be operatively connected to said control unit, said transmission unit being interconnected between said electromotor and said spindle for rotating the latter. Due to the utilization of the motion thread on the rotatable spindle it is possible that after the brake in the transmission gearing unit has been released upon a signal from the control unit, and also due to the fact that the energy has been stored in the spring means, the threaded nut and the loaded piston, which is under a hydraulic damping action, are pressed backwardly so that the door wing can be guided backward to its closed position in the known fashion.

According to a modified embodiment of the invention the supporting member may be formed as a pressure disc loaded by said spring means to displace said piston. The door lock may further include an elongated piston rod rigidly connected to said pressure disc at one end thereof and extended through said spring means, said piston rod being axially displaceable in said bore of said housing portion. A clamping piston may be rigidly connected to said piston rod at an end thereof opposite to said one end. The lock may further include an extension cylinder separated from said piston-cylinder unit and having a pressure medium chamber in which said clamping pistion is displaceably located. The lock structure may further include a pump and a control valve connected to said pump, said pump being connected to and being operable by said electromotor, said control valve being connected to said pressure medium chamber and being actuated by said control unit so as to control a flow of the pressure medium to and from said pressure medium chamber for displacing said clamping piston within said pressure medium chamber.

Due to the provision of the door lock with an electronic control unit it is possible that when a door contact switch is actuated by applying a very low pressure to a door detent, the control logic unit is actuated in such a direction that the prestressing of the spring means to a certain stroke of the piston is caused.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
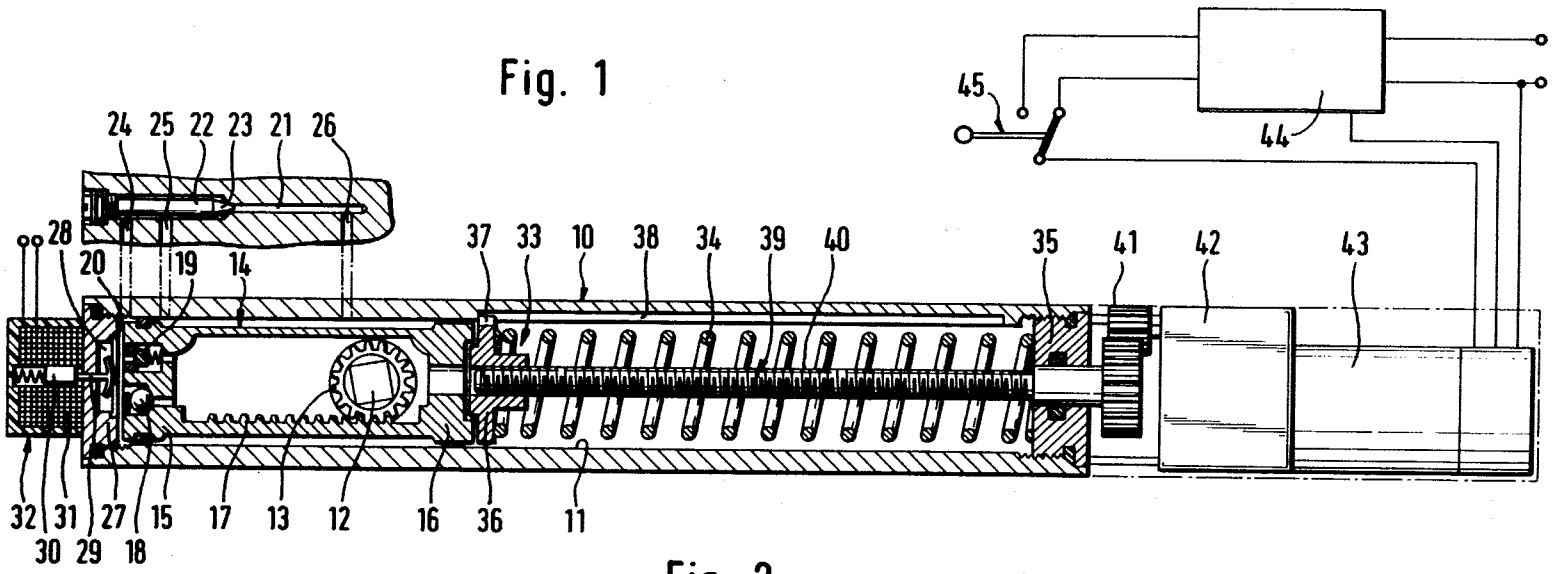
FIG. 1 is an axial sectional view of the door lock with the schematically illustrated electromotor and control computing unit, according to one embodiment of the invention.

Referring now to the drawings and first to FIG. 1, the door lock of the present invention includes a longitudinal square-shaped housing with a cylindrical housing portion 10 formed with an elongated cylindrical bore 11 extended through the length of housing 10 and closed at its opposite sides with two threaded plugs 27 and 35 which will be explained in detail hereinafter. Transversely of the elongation of housing 10 are provided in the known fashion two opposite stepwise bores which are aligned with one another and which receive respective bearing inserts with sealing rings (these bores are not shown in the drawings). A locking shaft 12 is rotatably guided in those bearing inserts in the known manner. The locking shaft 12 has in the middle region thereof a pinion 13. Both end portions of locking shaft 12 are arranged for a rotation-fixed receiving of non-illustrated arms of the door locking bar-structure for fixing a connection between the door frame and the door wing, for example by mounting square bars.

A hollow piston 14 is arranged in cylindrical bore 11 so that it is longitudinally displaceable within that bore. Piston 14 is comprised of a first pistion head 15, a second piston head 16 and a bar-like intermediate portion 17 formed as a rack and extended between piston heads 15 and 16. Rack 17 is engaged with pinion 13 of the locking shaft 12. Rotation movements of the locking shaft 12 cause longitudinal displacements of piston 14 in two opposite directions. A check valve 18 is arranged in the piston head 15 in cylindrical bore 11. Valve 18 opens towards a space or chamber 20 lying at the left-hand side of the piston head 15. Outside the check valve 18 is arranged a spring-biased overpressure valve 19 which also is positioned in the piston head 15. The overpressure valve 19 opens only when overpressure occurs in the chamber 20 at the left-hand side of the piston head 15, which happens, for example when the door wing is closed by force.

A steplike bore 21 which extends parallel to cylindrical bore 11 is also formed in the housing 10. A shoulder between two stepped portions of bore 21 forms a seat which receives a throttle valve cone 23 of a throttle valve 22 threadedly inserted into a left-hand portion of bore 21. The throttle valve 22 has the valve cone 23 which can extend into a narrower portion of bore 21 to limit a flow of a pressure medium therethrough. Two transverse bores 24 and 25 which extend from bore 11, open into an annular space in bore 21, surrounding the throttle valve 22. A further transverse bore 26, which is remote from piston head 15, extends between a narrower portion of bore 21 and bore 11 in the region of the bar-like intermediate portion of piston 14.

The left-hand side of the housing 10 of the door lock is closed by threaded plug 27 with the aid of a respective sealing ring, plug 27 being screwed into the end of bore 11. Plug 27 has a chamber 28 separated from chamber 20 by a diaphragm. A plunger 29 with a mushroom-like head of a spring-loaded core pin 30 of a signal coil system 32 extends into chamber 28. The signal coil system 32 further includes a coil 31 surrounding the core pin 30 which merges, as mentioned above, into plunger 29.

A supporting member 33 facing the piston head 16 of piston 14 is mounted in bore 11. This supporting member is loaded by a spring arrangement 34 which acts in the direction of displacement of piston 14 to the left, e.g. in the direction of closing of the door wing. The spring arrangement 34 acting as a locking compression spring is supported at another end thereof by means of the threaded plug 35 which sealingly closes the end of bore 11.

In the embodiment shown in FIG. 1 the supporting member 33 includes a threaded nut 36 which has a projection 37 which is extended outwardly radially and engaged in a longitudinal groove 38 formed in housing 10 as an extension of bore 11. Thereby nut 36 is longitudinally displaceable but can not be rotated in housing 10 of the door lock. Nut 36 surrounds a spindle 39 provided with a thread 40 on the outer circumference thereof and rotationally and sealingly supported in plug 35 but axially fixed. Spindle 39 can be driven by means of an intermediate gearing 41 and gear transmission unit 42 provided with a special conventional brake, and an electromotor 43 the output end of which is connected in the known fashion to the gear transmission unit 42. A control logic or computing unit 44 is interconnected between a net and electromotor 43. The contol computing or logic unit 44 can control, on the one hand, the signal coil system 32, with which it is electrically connected, and, on the other hand, a door contact switch 45. The door contact switch 45 can be advantageously actuated by a catch or lock pin or bolt provided on the door wing and cooperating with a locking plate on the door edge, or by a special door button.

Figure 2:
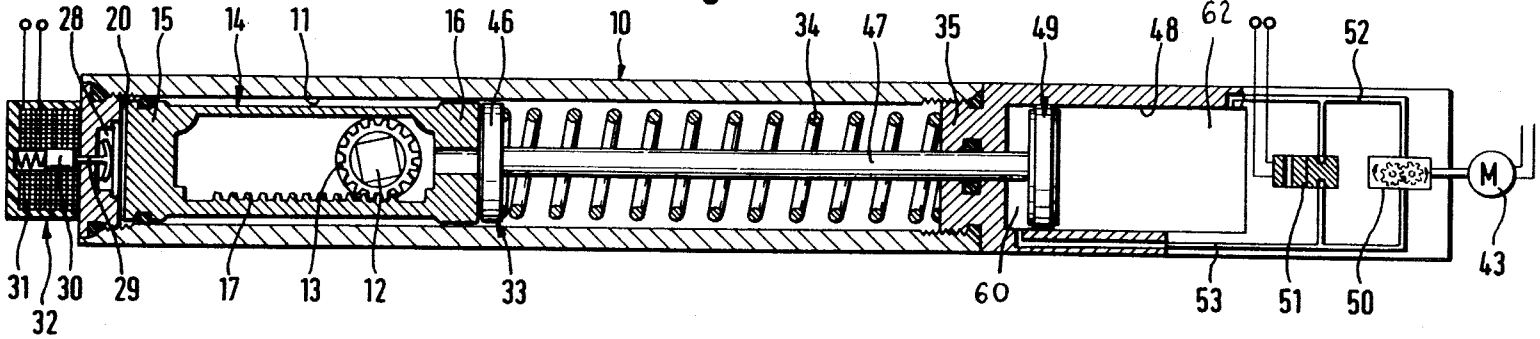
FIG. 2 is an axial sectional view of the door lock according to a modified embodiment of the invention.

In the embodiment of FIG. 2 the piston 14, the signal coil system 32 and the pressure medium throttle means are arranged similarly to those of the embodiment of FIG. 1. The supporting member 33 of the embodiment of FIG. 2, however, is formed as a pressure disc 46 axially displaceable in bore 11 of housing 10, pressure disc 46 being rigidly connected to a piston rod 47 urged in the axial direction by the spring arrangement 34 as in the embodiment of FIG. 1. The piston rod 47 further extends into the plug 35, which in this embodiment is formed as an extension cylinder 48 of the main cylinder formed by bore 11 in housing 10. A clamping piston 49 connected to the piston rod 47 is located in the extension cylinder 48. This schematically illustrated extension cylinder 48 further accommodates a pump 50 driven by the electromotor 43 and a control valve 51. Passages 52 and 53 respectively connected to pump 50 each open into the piston chamber formed in extension cylinder 48 at one location defined before clamping piston 49 and another location found behind clamping piston 49, taking into consideration the whole piston stroke. The control valve 51 is arranged parallel to pump 50 and is interconnected between passages 52 and 53. A pressure medium flow can pass through pump 50 only when the control valve 51 is closed, but when the control valve is opened the pressure medium can flow from the cylinder space 60 located before clamping piston 49 through the parallel passage directly back into cylinder space 62 disposed behind the clamping piston 49 and avoiding the pump 50.

The operation of the door lock according to the invention is as follows:

For the description of the mode of operation of the door lock let's assume that the lock is in the position in which the door wing is pulled away from its closed position. If now the door contact switch 45 is actuated by the door button or by the lock pin on the door wing, the control unit 44 is activated so that the motor 43 is switched on. In the embodiment of FIG. 1 electromotor 43 will drive the spindle 39 via gear transmission 43 and intermediate gearing 41, whereas in the embodiment of FIG. 2 electromotor 43 will actuate pump 50 and clamping piston 49 so that in both embodiments the supporting member 33 will be displaced to the right against the force of spring arrangement 34. The axial displacement of supporting member 33 is determined in accordance with the time of running of the motor, adjusted in the control logic unit 44; this period of time can be adjusted so that the amount of the displacement of the supporting member 33 would correspond to a predetermined angle of opening of the door. If the door wing is now actually opened, the piston 14 will move whereby overpressure will occur in the space 20, which overpressure would actuate plunger 29 to cause a respective electrical impulse in the signal coil system 32, said impulse will be transmitted to the control logic unit 44. Electromotor 43 then will receive a command which will cause the spring 34 to further compress, and that is always in accordance with the amount of advancement of the door wing, this amount is adjusted when the door wing is closed.

When the door is opened quickly, a correspondingly greater overpressure in the chamber 20 before the piston 14 occurs and a respectively changed signal is transmitted from the signal coil system 32 to the control unit 44, which in turn sends a command "to rotate faster" to the electromotor 43.

In the instant at which the opening movement of the door wing has been completed the pressure in the chamber 20 rises to reach a normal value whereby due to a corresponding movement of plunger 29 and the change in the value of the signal transmitted from the signal coil system 32 to the control unit 44, the motor 43 receives the command "stop".

In the embodiment of FIG. 1 at the end of the running of the motor the special brake in transmission unit 42 is immediately actuated and closes unit 42 to hold the nut 36 in the stop position. In the embodiment of FIG. 2 if the motor 43 is inoperative no pressure medium is pumped by pump 50 into the extension cylinder 48 so that balanced volume conditions before clamping piston 49 and behind this piston in the cylinder chamber of the extension cylinder 48 are maintained and the clamping piston 49 is stably held together with the pressure disc 46 and piston rod 47 in the attained position against the locking force of the spring arrangement 34.

After a short preselected period of time the electromotor 43 receives from the control unit 44 the command "to load the spring" and then in the embodiment of FIG. 1 the brake releases the gearing unit 42 whereas in the embodiment of FIG. 2 the control valve 51 is controlled in such a fashion that the pressure medium can flow from the cylinder space 60 before clamping piston 49 via passage 53 into passage 52 and from the latter into cylinder space 62 behind the clamping piston 49. Thereby in both instances (FIG. 1 and FIG. 2) the spring arrangement 34 is forced so that the supporting member 33 is displaced forwardly whereby piston 14 will be also displaced in the direction towards the front end of the housing, facing the signal coil system 32. The locking shaft 12 thereby, by means of rack 17, will be rotated in the direction of closing the door so that the door wing will be moved to its closed position. The movement of the door wing to its closed position is hydraulically damped by means of the throttle valve 22 engaged in passages 26, 21, 24 and 25. As soon as the door wing is completely closed and the locking pin or bolt on the door wing is inserted into the locking plate the door contact switch 45 is again actuated in the direction "closed" and electromotor 43 again receives its first command to move the supporting member 33 so that its stroke would correspond to a preselected angle of the door opening.

If, after a first operation of the door button, no opening of the door follows, the control unit 44 will react in the same manner as at the end of the movement of the door to the open position and will give, after a predetermined period of time, to the electromotor 43 and thus to the brake of transmission unit 42 or to control valve 51, the command "to load the spring", so that the full closing force will again act on the piston 14 to cause the door wing to move slowly.

In the event of failure of electric power the electromoter 43 and the control unit 44 are, of course, inoperative, which means that the spring arrangement 34 remains unloaded so that the supporting member 33 permanently bears against piston 14 which is permanently loaded in the direction of closing the door. In this situation it is obvious that each time when of the door wing opens the spring arrangement becomes more and more prestressed. This results in the fact that the door lock is produced in a very safe manner even in the case of failure of external energy applied to the spring arrangement, particularly in the form of electric current.

As has been mentioned above many other modifications of the invention are possible. It is, for example conceivable that the electric current obtained from an independent electric source can be replaced by any other form of energy. Furthermore, the signal coil system for transmitting a signal to the control logic unit has been described as an example and can be, of course, replaced by another suitable conventional system which would transform the magnitude of the movement of the piston into an information signal to be supplied to the control unit which may not be necessarily an electric logic unit.

It will be understood that each of the elements described above, or two or more together, may also find a useful application in other types of automatic door locks differing from the types described above.

While the invention has been illustrated and described as embodied in an automatic door lock, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristcs of the generic or specific aspects of this invention.

What is claimed as new and desired to be protected by Letters Patent is set forth in the appended claims:

1. In an automatic door lock for opening and closing a door wing, comprising a housing having an elongated cylindrical portion formed with a cylindrical bore, a hydraulic piston-cylinder unit including a piston displaceable in said bore, a rotatable locking shaft connected to the door wing and cooperating with said piston and rotatable upon displacing of said piston in said bore to effect a movement of the door wing to a closed postion and to an opened position; spring means disposed in said bore and operative for loading said piston and said locking shaft in the direction of closing the door wing, said piston-cylinder unit having a pressure chamber, said housing being formed with a pressure medium return passage; throttle means in said return passage; a check valve opening into said pressure chamber, said pressure chamber of the piston-cylinder unit being connected at one side thereof with said return passage via said throttle means and at another side thereof with said check valve; the improvement comprising a movable supporting member interconnected immediately between said piston and said spring means; and an external energy source, said supporting member being controllably driven by the external energy source in the direction of prestressing of said spring means in dependence upon operation of the door wing.

2. The door lock as defined in claim 1, further including an electronic control unit and an electromotor electrically connected to said unit and operative for driving said supporting member, the movement of said supporting member being controlled by said control unit upon the operation of the door wing.

3. The door lock as defined in claim 2, further including a signal coil system electrically connected to said control unit for generating control signals transmitted to said control unit, said signal coil system being operatively connected to a pressure space located in said housing before said piston and being operative under underpressure.

4. The door lock as defined in claim 3, wherein said supporting member is formed as a threaded nut loaded by said spring means to displace said piston.

5. The door lock as defined in claim 4, further including an elongated spindle having a thread thereon and mounted in said bore of said housing portion, said threaded nut surrounding said spindle and being guided in said bore unrotationally, said spindle extending through said spring means and being rotatably but axially stationarily supported in said housing portion within said bore.

6. The door lock as defined in claim 5, wherein said housing portion is formed with an elongated guide groove in the region of said bore for guiding said threaded nut in the movement thereof in said bore.

7. The door lock as defined in claim 6, further including a transmission unit having a brake operatively connected to said control unit, said transmission unit being interconnected between said electromotor and said spindle for rotating the latter.

8. The door lock as defined in claim 3, wherein said supporting member is formed as a pressure disc loaded by said spring means to displace said piston.

9. The door lock as defined in claim 8, further including an elongated piston rod rigidly connected to said pressure disc at one end thereof and extended through said spring means, said piston rod being axially displaceable in said bore of said housing portion.

10. The door lock as defined in claim 9, further including a clamping piston rigidly connected to said piston rod at an end thereof opposite to said one end.

11. The door lock as defined in claim 10, further including an extension cylinder separated from said piston-cylinder unit and having a pressure medium chamber in which said clamping piston is displaceably located.

12. The door lock as defined in claim 11, further including a pump and a control valve connected to said pump, said pump being connected to and being operable by said electromotor, said control valve being connected to said pressure medium chamber and being actuated by said control unit so as to control a flow of the pressure medium to and from said pressure medium chamber for displacing said clamping piston within said pressure medium chamber.

13. The door lock as defined in claim 3, wherein said piston includes a rack and said locking shaft includes a pinion engaged with said rack.

* * * * *